United States Patent [19]

Butzen

[11] Patent Number: 4,648,218

[45] Date of Patent: Mar. 10, 1987

[54] INTERLOCKING ROOF EDGE FASCIA SYSTEM

[76] Inventor: William J. Butzen, N57 W15167 Mesa Dr., Menomonee Falls, Wis. 53051

[21] Appl. No.: 739,663

[22] Filed: May 31, 1985

[51] Int. Cl.[4] ..... E04B 7/00

[52] U.S. Cl. ..... 52/96; 52/60; 52/526

[58] Field of Search ..... 52/96, 94, 60, 58, 735, 52/526, 546, 523, 527–531

[56] References Cited

U.S. PATENT DOCUMENTS

| | | | |
|---|---|---|---|
| 2,486,326 | 10/1949 | Ronzone | 52/526 |
| 2,676,553 | 4/1954 | Orth | 52/60 |
| 3,012,376 | 12/1961 | Reddy et al. | 50/66 |
| 3,086,324 | 4/1963 | Cheney | 50/66 |
| 3,100,951 | 8/1963 | Hickman | 50/66 |
| 4,037,372 | 7/1977 | Patry | 52/96 |
| 4,071,987 | 2/1978 | Hickman | 52/94 |
| 4,155,203 | 5/1979 | Wolma | 52/60 |
| 4,241,549 | 12/1980 | Hall, III et al. | 52/60 |
| 4,419,850 | 12/1983 | Butzen | 52/60 |

FOREIGN PATENT DOCUMENTS

| | | | |
|---|---|---|---|
| 2084628 | 4/1982 | United Kingdom | 52/96 |

*Primary Examiner*—Carl D. Friedman
*Assistant Examiner*—Naoko N. Slack
*Attorney, Agent, or Firm*—Joseph S. Heino

[57] ABSTRACT

A roof edge fascia system having a dam-cant for supporting the edges of a waterproof membrane and a plurality of snap-on fascia cap members for covering the dam-cant and for clamping the membrane against the dam-cant is provided with means for expansibly interlocking a plurality of longitudinally extending snap-on fascia cap members.

3 Claims, 5 Drawing Figures

INTERLOCKING ROOF EDGE FASCIA SYSTEM

SUMMARY OF THE INVENTION

This invention relates to roof edging mechanisms used to secure the edges of a roof-top waterproof membrane and more particularly to an improved roof edge fascia system for expansibly interlocking contiguously overlapping roof edge fascia members. This invention also specifically relates to an improvement of the inventor's roof edge fascia system disclosed in U.S. Pat. No. 4,419,850.

In the construction of the inventor's roof edge fascia system, a dam means is secured to the edge of a roof. The dam means includes a horizontal portion adapted to be secured to the roof, and an upwardly inclined portion having an upper edge and a vertical portion extending downwardly from the upper edge. A waterproof membrane is laid across the surface of the roof such that the edges of the membrane are laid up against the inclined portion of the dam means, over the upper edge and down against the outside surface of the vertical portion. A snap-on cap is also included which overlies and clampingly engages the dam means and the interposed membrane.

In practice, the dam means of the inventor's roof edge fascia system includes a plurality of overlapping dam members and a plurality of overlapping cap members, each of which is comprised of a formed sheet metal material. The inventor has been apprised of a disadvantage in his system which is that the overlapping cap members tend to shift due to thermal expansion and contraction thereby leaving gaps and exposing the underlying membrane therebetween. It has been the practice in other such systems to employ a cover plate to overlie the abutting or overlapping edges of adjacent fascia members to conceal the space therebetween. For example, in U.S. Pat. No. 3,012,376 a butt joint clip (see FIG. 2) made similar in configuration to but slightly larger than fascia members 19 is installed over the joints of the fascia members 19 and is held in place by tension. Other such cover plates are shown in U.S. Pat. Nos. 3,100,951; 4,037,372; and 4,155,203. These types of plates do not prevent abutting or overlapping fascia members from shifting nor is there anything to prevent the plates themselves from shifting.

It is, therefore, a principle object of this invention to provide an improved fascia system which is capable of compensating for expansion and contraction and which remains well aligned and in place at all times. It is another object of this invention to provide such a system without requiring the fabrication of an additional member but rather by modifying existing members. It is still another object of this invention to provide such a system which is uncomplicated in design, economically manufacturable and easily assembled in the field and which accomplishes all of this without piercing the fascia members or the underlying membrane while creating an aesthetically pleasing fascia system from all points outside of the building.

The improvement of the present invention has obtained these objects. It provides for an improved snap-on cap member which is notched at each end of its downwardly extending vertical portion. The improved cap member is further provided with an engaging fin at one end of its upwardly inclined portion and a corresponding opening at the other end. In this configuration, contiguously overlapping cap members are expansibly interlocked thereby facilitating installation of the cap members in the field without requiring the use of an additional intermediate member. The foregoing and other features of the improvement of the present invention will be further apparent from the description which follows.

DETAILED DESCRIPTION

Figure 1:
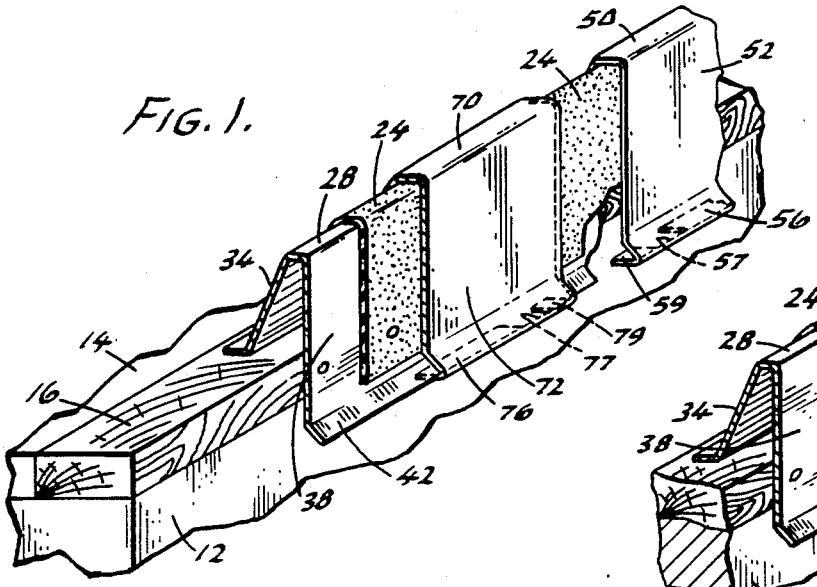
FIG. 1 is a perspective view of a roof edging mechanism embodying the present invention.
Figure 2:
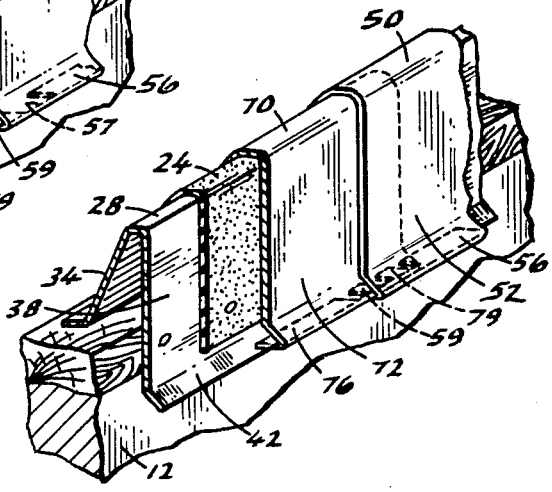
FIG. 2 is a view similar to FIG. 1 but with the snap-on caps in a secured position
Figure 3:
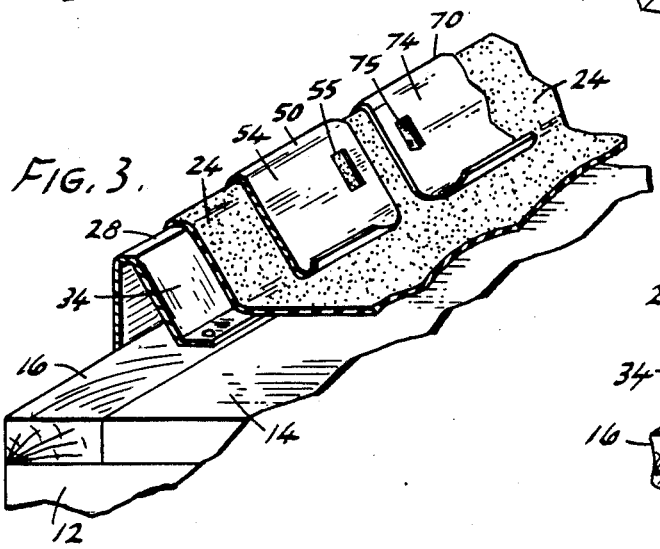
FIG. 3 is a perspective view from the side opposite that shown in FIG. 1.
Figure 4:
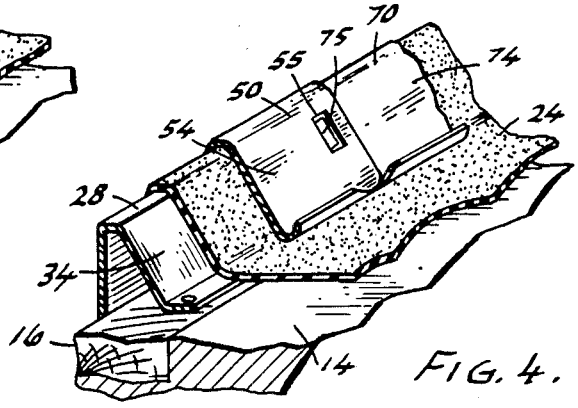
FIG. 4 is a perspective view similar to but from the side opposite that shown in FIG. 2.

Reference is now made more particularly to the drawings and particularly to FIGS. 1 and 2 which show the improved roof edge fascia system constructed in accordance with the present invention. As shown, a water dam-cant or dam means 28 is secured to the wood nailer 16 which is located at the top of a wall 12 and at the edge of a roof 14. The cant 28 is comprised of sheet metal material and includes an upwardly inclined portion 34 and a vertical portion 38 having a downwardly extending lower edge 42. After the cant 28 has been secured in place, the roof 14 is covered with a waterproof membrane 24. The membrane 24 is adapted to extend up the inclined surface 34 and downwardly against the outside of the vertical wall 38 of the cant 28. Means for securing the edges of the membrane 24 in place is provided by snap-on caps 50, 70, each comprised of a sheet metal material and having an inclined portion 54, 74 and a fascia or vertical portion 52, 72. See FIGS. 3 and 4. Each of the vertical portions 52, 72 of the snap-on caps 50, 70 include a lower end portion 56, 76, bent so as to include a downwardly and outwardly extending portion 58, 78, and an inwardly extending lip 60, 80, thereby defining a channel for receiving the downwardly extending lower edge 42 of the cant 28. See FIG. 5.

Figure 5:
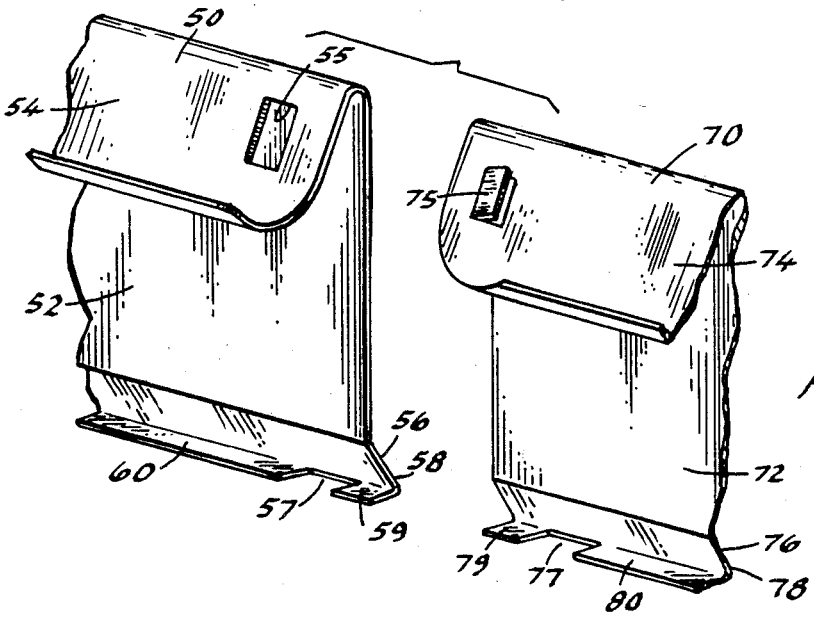
FIG. 5 is a detailed perspective view showing the ends of adjacent snap-on caps.

In the improved fascia system, means for interlocking the snap-on caps 50, 70, is provided. As shown in FIG. 5, the first snap-on cap 50 is provided with an opening 55 located at one end of the inclined portion 54 and with a notch 57 and interlocking member 59 located at the same end of the inwardly extending lip 60. The second snap-on cap 70 is provided with an outwardly extending interlocking fin member 75 located at one end of the inclined portion 74 and with a notch 77 and interlocking member 79 located at the same end of the inwardly extending lip 80. While not shown, it is to be understood that the first cap 50 is provided at its other end with the elements provided for the end of the second cap 70 shown in FIG. 5 and that the second cap 70 is provided at its other end with the elements provided for the end of the first cap 50 shown in FIG. 5.

During installation of the snap-on caps 50, 70, as they are forced downwardly over the cant 28, the lower edges 56, 76, of the fascia portions 52, 72, will slide downwardly and outwardly on the external surface of the outwardly inclined portion 42 of the cant 28. When the snap-on caps 50, 70, are in place, the lips 60, 80, will then snap under the lower edge of the vertical portion 42 of the cant 28. The first snap-on cap 50 is then urged along the cant 28 toward the second cap 70 until the first cap 50 overlaps the second cap 70 to the point where the opening 55 of the first cap 50 engages the fin member 75 of the second cap 70 and where the interlocking lip member 59 of the first cap 50 engages the notch 77 of the second cap 70 and the interlocking lip member 79 of the second cap 70 engages the notch 57 of the first cap 50. Alternatively, the first cap 50 can be secured after the second cap 70 is in place by overlapping a portion of the second cap 70 with the first cap 50 and forcing the first cap 50 downwardly over the cant 28 and overlapping portion of the second cap 70 until the caps 50, 70, are interlockingly engaged as hereinbefore described. This double interlock concept allows for thermal movement of the caps 50, 70, while preventing cap separation. In practice, the caps 50, 70, are typically 10 foot long sections with approximately 1¼ inch cap lap joints which allow for thermal movement of approximately ½ inch per 10 foot section.

Aside from providing for roof fascia caps which permit thermal movement without separation, other advantages of the present invention are that the interlocking elements hereinbefore described can be machined into existing caps and that field assembly of the caps is easily accomplished without requiring the use of other steps, devices or materials. Another substantial advantage of the invention is that the interlocking elements are so incorporated into the caps so as not to interfere with the aesthetics of the fascia. See FIG. 2.

From the foregoing detailed description of the illustrative embodiment of the invention set forth herein, it will be apparent that there has been provided an improved roof edge fascia system for expansibly interlocking contiguously overlapping roof edge fascia members.

The principles of this invention having been fully explained in connection with the foregoing, I hereby claim as my invention:

1. In a roof edging mechanism for providing a dam at the edge of a roof and for securing the edge of a rubber membrane overlying the roof in place, said roof edging mechanism having a dam means adapted to be secured to the edge of the roof and a fascia for covering at least a portion of said dam means and for clampingly engaging said rubber membrane, the improvement comprising a fascia having a plurality of fascia members wherein each fascia member has a first and second end, a vertical portion having an upper and lower edge extending between said ends, and an inclined spring portion extending downwardly from said upper edge between said first and second ends, and means for expansibly interlocking said fascia members, said interlocking means including an outwardly extending fin member located at the inclined spring portion of said first end, an opening located at the inclined spring portion of said second end, said first end fin member adapted to be received by and interlockingly engaged with said second end opening, a first notch and first lip member located at the lower edge of said first end and a second notch and second lip member located at the lower edge of said second end, said first end lip member adapted to be received by and interlockingly engaged with said second end notch and said second end lip member adapted to be received by and interlockingly engaged with said first end notch, whereby contiguously overlapping fascia members are expansibly interlocked.

2. In a roof edging mechanism adapted to provide a dam at the edge of a roof and to provide a means for securing the edge of a rubber membrane to the edge of the roof, said roof edging mechanism having a dam means adapted to be secured to a roof and adjacent to a wall, the dam means including an inclined portion having a lower edge engaging the roof and having an upper edge and a vertical portion connected to the inclined portion at said upper edge and adapted to extend downwardly with at least a portion of said vertical portion being adjacent the wall, said vertical portion having a lower edge, and said dam means being adapted to support a rubber membrane thereon and a fascia for covering at least a portion of said dam means and for clampingly engaging the portion of said rubber membrane in the area where said lower edge of said inclined portion of said dam means engages the roof, the improvement comprising a fascia a plurality of fascia members each including a vertical portion adapted to overlie said vertical portion of said dam means, said fascia vertical portion having a first and second longitudinal end, a lower edge including means adapted to engage the lower edge of said vertical dam portion and an upper edge, said fascia vertical portion lower edge having a notch and lip member located at each longitudinal end, said notches adapted to be interlockingly engaged with said lip members, and each of said fascia members including an inclined portion extending downwardly from said vertical portion upper edge, said inclined portion including a lower edge adjacent said lower edge of said inclined portion of said dam means and said fascia member inclined portion being resilient and constructed such that said lower edge of said inclined portion clampingly engages said membrane in the area where said lower edge of said inclinded dam portion engages a roof, said inclined portion having an opening located at one longitudinal end and an outwardly extending fin member located at the other longitudinal end, said opening adapted to be interlockingly engaged with said fin member, said fascia members being adapted to be forced downwardly over said dam means to clamp said rubber membrane in place on said dam means and to expansibly interlock a plurality of contiguously overlapping fascia members overlying said dam means.

3. In a roof edging mechanism for providing a dam at the edge of a roof and for securing the edge of a rubber membrane overlying the roof in place, said roof edging mechanism having a dam means adapted to be secured to the edge of the roof and comprised of a sheet of metal material, and a fascia for securing said rubber membrane against said dam means and against said roof, the improvement comprising a plurality of fascia members each comprised of a sheet of resilient metal material and including a first and second longitudinal end, a vertical planar fascia portion, said vertical portion extending between said first and second longitudinal end and having a lower and upper edge, and an inclined portion extending between said first and second longitudinal end and extending downwardly from said vertical portion upper edge, said vertical planar fascia portion including a notch and lip member located at each end of the lower edge, said notches adapted to be interlockingly engaged with said lip members, and said inclined portion having an outwardly extending fin member located at said first fascia end and an opening located at the second end of said fascia member, said opening adapted to be interlockingly engaged with said fin member, whereby overlappingly contiguous fascia members are expansibly interlocked.

* * * * *